US011528975B2

(12) United States Patent
Grupper

(10) Patent No.: US 11,528,975 B2
(45) Date of Patent: Dec. 20, 2022

(54) MODULAR CREDIT CARD SLEEVE ASSEMBLY

(71) Applicant: Eddie Grupper, Brooklyn, NY (US)

(72) Inventor: Eddie Grupper, Brooklyn, NY (US)

( * ) Notice: Subject to any disclaimer, the term of this patent is extended or adjusted under 35 U.S.C. 154(b) by 501 days.

(21) Appl. No.: 16/692,454

(22) Filed: Nov. 22, 2019

(65) Prior Publication Data

US 2020/0187614 A1 Jun. 18, 2020

Related U.S. Application Data

(60) Provisional application No. 62/779,504, filed on Dec. 14, 2018.

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/065* (2013.01); *A45C 2200/10* (2013.01)

(58) Field of Classification Search
CPC ... A45C 11/182; A45C 1/06; A45C 2001/065; A45C 2200/10; B42D 25/22; B42F 7/06
USPC ..... 150/145, 147, 148, 132, 133
See application file for complete search history.

(56) References Cited

U.S. PATENT DOCUMENTS 4,589,549 A * 5/1986 Hehn ..... E05B 73/0023 70/401
2002/0088516 A1* 7/2002 Olson ..... A45C 1/06 150/135
2020/0016920 A1* 1/2020 Ong ..... B42F 7/06

* cited by examiner

*Primary Examiner* — Sue A Weaver
(74) *Attorney, Agent, or Firm* — Jacob M. Ward; Ward Law Office LLC

(57) ABSTRACT

A modular card sleeve has a hollow main body and a flap. The hollow main body includes an opened end, a closed end, a front side, a rear side, a leading edge, and a trailing edge. The opened end is configured to receive a card for placement of the card within the hollow main body. The closed end is disposed opposite the opened end. The rear side has a first pouch and a second pouch disposed thereon. The first pouch has a first opening. The second pouch has a second opening. The first opening of the first pouch faces the second opening of the second pouch. The flap has a first wing, a second wing, and at least one connecting portion. The at least one connecting portion is disposed between the first wing and the second wing. The at least one connecting portion is disposed on the front side.

20 Claims, 4 Drawing Sheets

MODULAR CREDIT CARD SLEEVE ASSEMBLY

CROSS-REFERENCE TO RELATED APPLICATIONS

This application claims the benefit of U.S. Provisional Application No. 62/779,504, filed on Dec. 14, 2018. The entire disclosure of the above application is hereby incorporated herein by reference.

FIELD

The present disclosure relates to a card sleeve and, more particularly, to a plastic sleeve for holding items such as credit cards, photographs, and identification.

BACKGROUND

The accumulation of credit cards, reward cards, photos, and licenses in a wallet is often inevitable. Undesirably, as the wallet becomes full, the wallet can be stretched. In addition, the storing of many items in the wallet leads to disorganization. This disorganization can also cause frustration on the part of a user during frequent, clumsy searches for credit cards and other items stored in the wallet.

One known solution for organizing items such as cards in wallets is to use "card sleeves." Card sleeves are individual plastic sheaths that provide discrete locations for placement of the cards within the wallet. The card sleeves can be either connected to the wallet or provided separately and inserted into a pocket of the wallet. However, these known card sleeves can also become disorganized. The wallet may also have too few or too many card sleeves, resulting in further frustration on the part of the user There is a continuing need for a card sleeve assembly that facilitates organization of items such as credit cards. Desirably, the card sleeve assembly is modular to accommodate different quantities of the items to be stored.

SUMMARY

In concordance with the instant disclosure, a card sleeve assembly that facilitates organization of items such as credit cards, and which is modular to accommodate different quantities of the items to be stored, has been surprisingly discovered.

In one embodiment, a modular card sleeve has a hollow main body and a flap. The hollow main body includes an opened end, a closed end, a front side, a rear side, a leading edge, and a trailing edge. The opened end is configured to receive a card for placement of the card within the hollow main body. The closed end is disposed opposite the opened end. The rear side has a first pouch and a second pouch disposed thereon. The first pouch has a first opening. The second pouch has a second opening. The first opening of the first pouch faces the second opening of the second pouch. The flap has a first wing, a second wing, and at least one connecting portion. The at least one connecting portion is disposed between the first wing and the second wing. The at least one connecting portion is disposed on the front side of the hollow main body.

In another embodiment, a modular card sleeve assembly has a plurality of modular card sleeves, including a first modular card sleeve and a second modular card sleeve. Each of the plurality of modular card sleeves have a hollow main body and a flap. The hollow main body has an opened end, a closed end, a front side, a rear side, a leading edge, and a trailing edge. The opened end is configured to receive a card for placement of the card within the hollow main body. The closed end is disposed opposite the opened end. The rear side has a first pouch and a second pouch disposed thereon. The first pouch has a first opening. The second pouch has a second opening. The first opening of the first pouch faces the second opening of the second pouch. The flap has a first wing, a second wing, and at least one connecting portion. The at least one connecting portion is disposed between the first wing and the second wing. The at least one connecting portion is disposed on the front side. The first wing of the second modular card sleeve is disposed within the first pouch of the first modular card sleeve. The second wing of the second modular card sleeve is disposed within the second pouch of the first modular card sleeve. The modular card sleeve assembly further includes a closed configuration, a horizontal spread configuration, and an open configuration.

In a further embodiment, a modular card sleeve assembly has a wallet and a plurality of modular card sleeves disposed in the wallet. The plurality of modular card sleeves includes a first modular card sleeve and a second modular card sleeve. Each of the plurality of modular card sleeves have a hollow main body and a flap. The hollow main body has an opened end, a closed end, a front side, a rear side, a leading edge, and a trailing edge. The opened end is configured to receive a card for placement of the card within the hollow main body. The closed end is disposed opposite the opened end. The rear side has a first pouch and a second pouch disposed thereon. The first pouch has a first opening. The second pouch has a second opening. The first opening of the first pouch faces the second opening of the second pouch. The flap has a first wing, a second wing, and at least one connecting portion. The at least one connecting portion is disposed between the first wing and the second wing. The at least one connecting portion is disposed on the front side. The first wing of the second modular card sleeve is disposed within the first pouch of the first modular card sleeve. The second wing of the second modular card sleeve is disposed within the second pouch of the first modular card sleeve.

In an exemplary embodiment, the modular credit card sleeve assembly for a wallet has one double sided flap piece on its front, and two flat, inverse, facing pockets on its back. The flap piece is a flat, flexible piece of material. Except for a lead flap piece in the modular card sleeve assembly, whose frontal surface is void of any added structure, the frontal surface of each of the other flat flap pieces is adhered only at its frontal center to the credit card sleeve. This adherence of the flat flap pieces allows the flap material's top and bottom edges to remain free, like wings. The top and bottom wings of the flap are utilized to slip smoothly into separate corresponding inverse, facing pockets of a sleeve that is directly toward the front of the modular credit card sleeve assembly.

Due to this unique structure, a series of sleeves that slip one into another that forms the modular credit card sleeve assembly by way of the flaps slipping into the pockets, which then correspond to the desired length by the wallet user. Over time, the wallet user can easily reverse or continue this process depending the need.

A modular credit card sleeve assembly for a wallet has at least two sleeves with one double sided flap piece on its front, and two flats, inverse, facing pockets on its back. The flap piece is a flat, flexible piece of material. Except for a lead flap piece in the modular card sleeve assembly (whose frontal surface is void of any added structure) the frontal surface of each of the other flat flap pieces is adhered only at its frontal center to the credit card sleeve. This adherence of the flat flap pieces allows the flap material's top and bottom edges to remain free, like wings. The top and bottom wings of the flap piece are utilized to slip smoothly into the separate corresponding inverse, facing pockets of a sleeve that is directly toward the front of the modular credit card sleeve assembly.

Consequently, the flaps fit relatively deep and flush within the pockets of their adjacent sleeve. Since they are not as wide as the pockets an extra width of roughly 0.5 inches of horizontal space within each pocket allows the double flap piece and its attached sleeve to slide freely about 0.5 inches from left to right within the pocket of its neighboring sleeve, but not freely up and down.

This type of sleeve attachment allows a user to store their cards flatter, easily add or remove as many sleeves as they need, and enables them to organize, view, find and manipulate a large number of cards with fluidity, utilizing a booklet style or horizontal spread style for viewing.

Other fan out styles and modular credit card organizers, standard or high end, don't offer the same amount of support, freedom, and versatility, nor are comparable designs as inexpensive to manufacture. The instant design is cheaply made, is practical, easy and fun to use, and can be freely adapted to function sleekly within numerous wallet designs.

The goal of this present invention is to help organize large amounts of credit cards and other items, so the cards are secure, take up less room in the wallet, and are instantly and easily accessible.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

Figure 4:
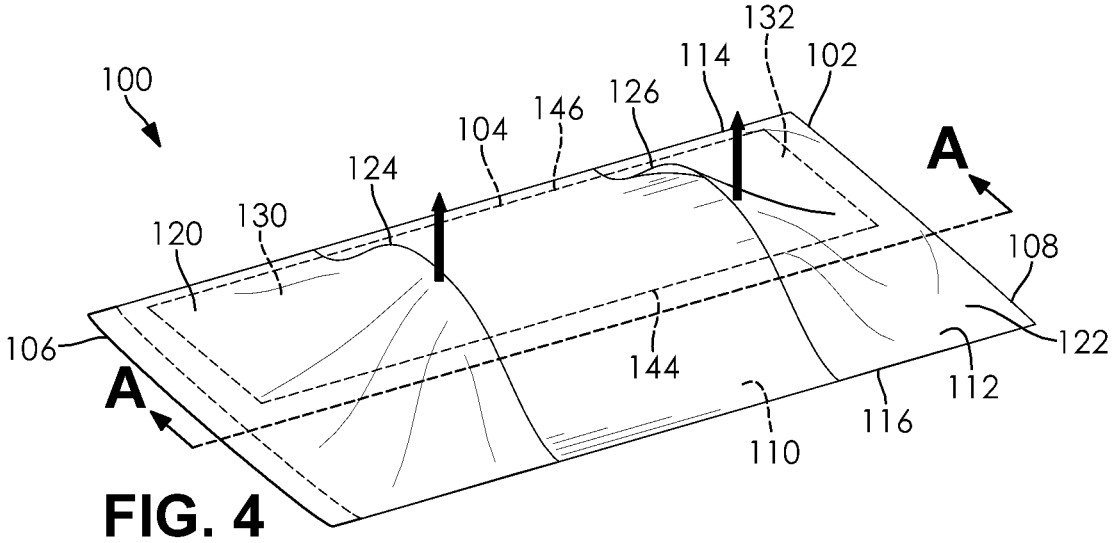
FIG. 4 is a rear perspective view of the modular card sleeve shown in FIG. 3, and further showing the openings of the first pouch and second pouch being pulled upwardly from the rear side of the modular card assembly.
Figure 5:
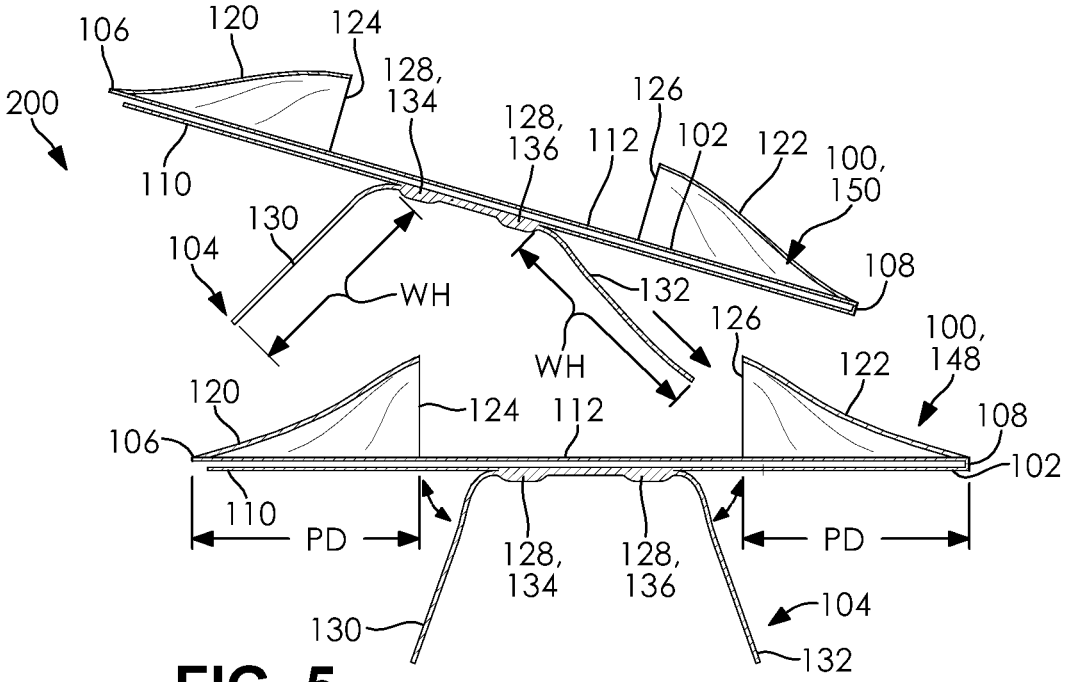
Figure 6:
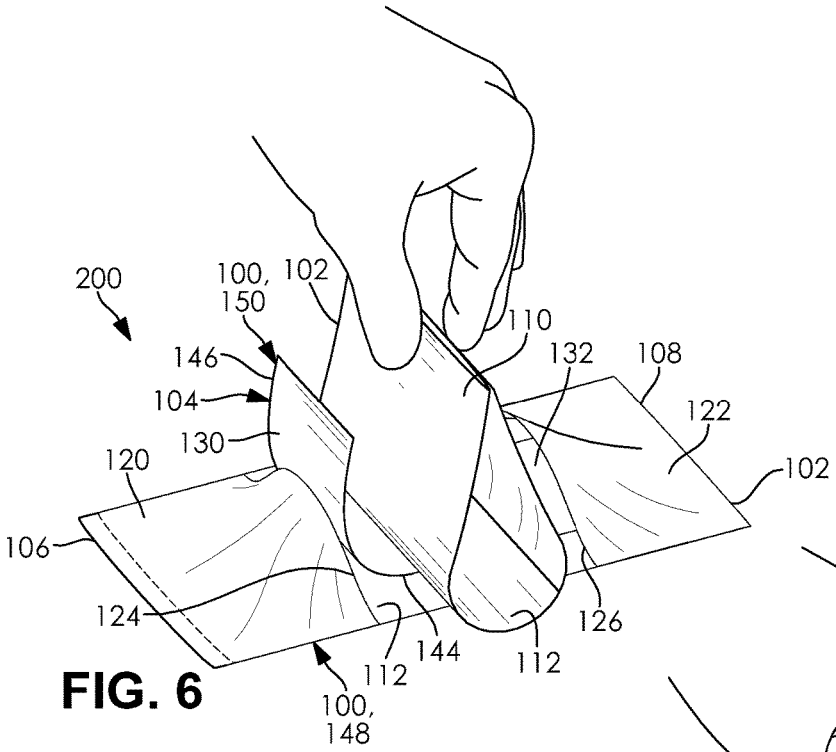
Figure 7:
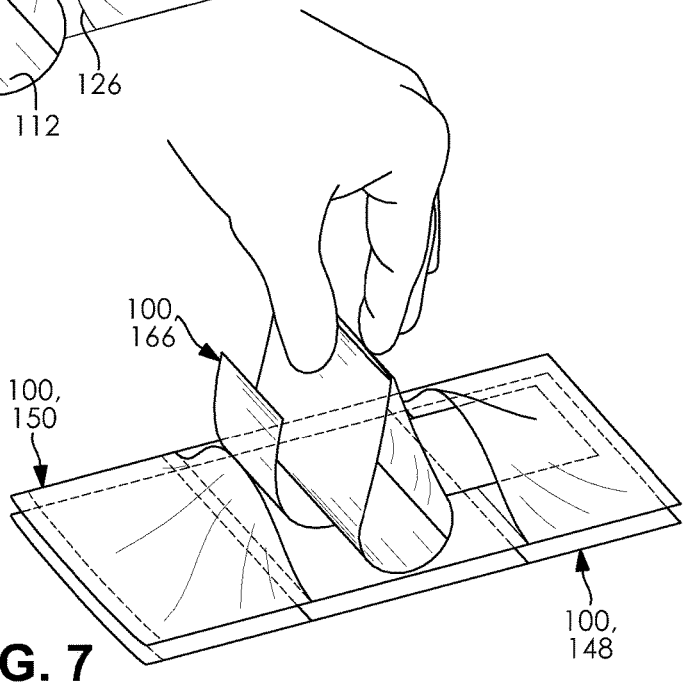
Figure 8:
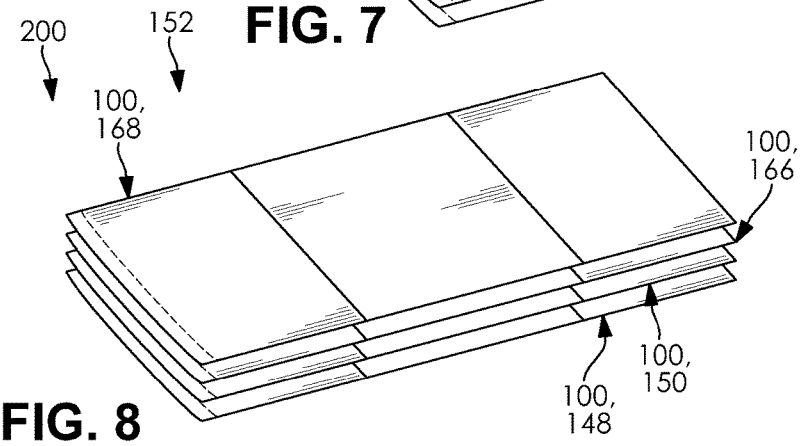
Figure 9:
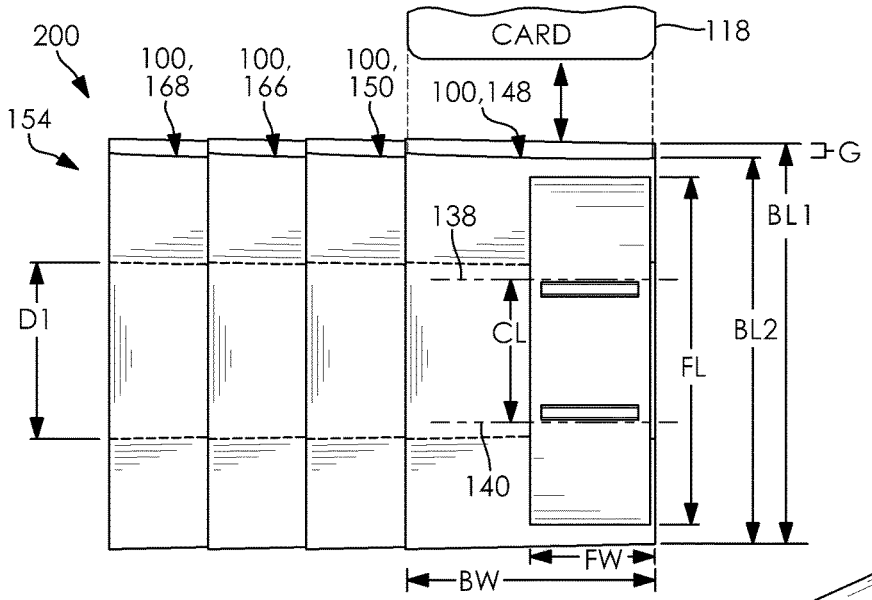
Figure 10:
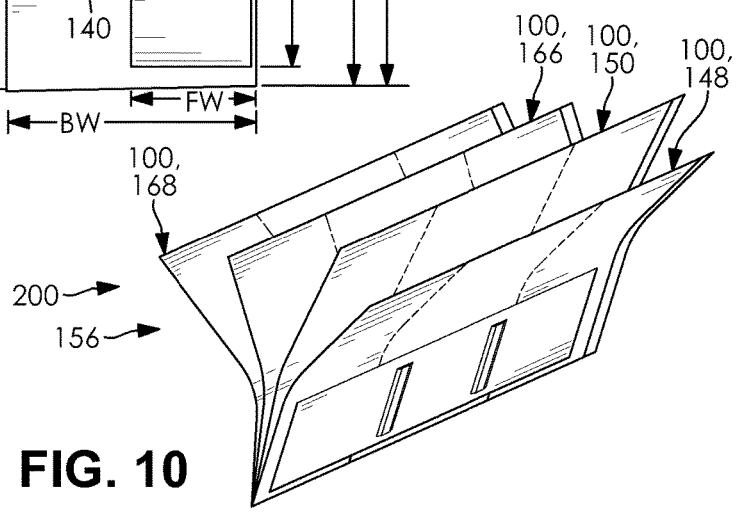
Figure 11:
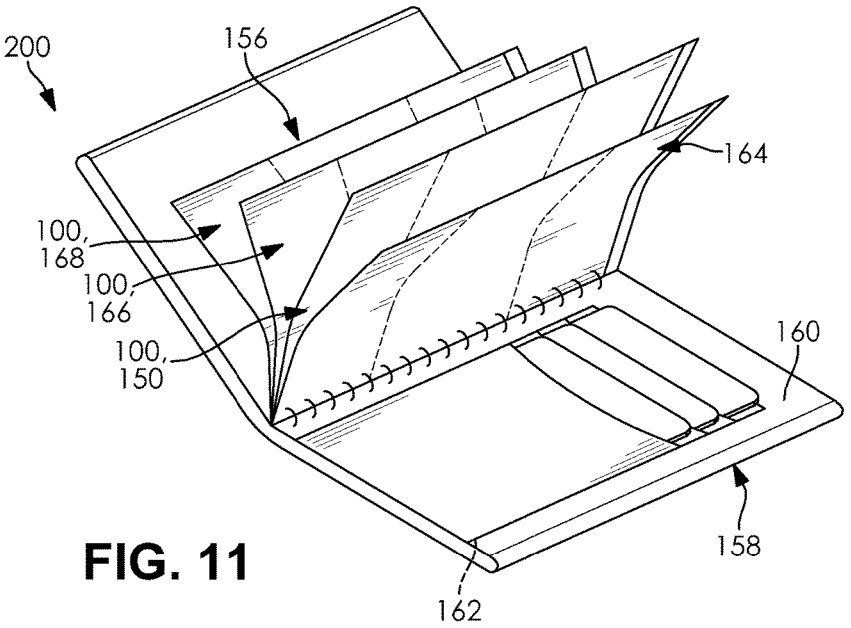

FIG. 5 is a cross-sectional side elevational view of a modular card sleeve assembly having a pair of the modular card sleeves taken at section line A-A in FIG. 4, the pair of modular card sleeves including a first modular card sleeve and a second modular card sleeve, and further showing the wing of the flap on the second modular card sleeve being inserted into the pouch of the first modular card sleeve;

FIG. 6 is a rear perspective view of the modular card sleeve assembly shown in FIG. 5, and further showing the wing of the flap on the second modular card sleeve having been inserted into the pouch of the first modular card sleeve;

FIG. 7 is a rear perspective view of the modular card sleeve assembly shown in FIG. 6, and further showing the addition of a third card sleeve to the assembly;

FIG. 8 is a rear perspective view of the modular card sleeve assembly shown in FIG. 7, and further showing four of the modular card sleeves being fully assembled, and the modular card sleeve assembly illustrated in a closed configuration;

FIG. 9 is a front elevational view of the modular card sleeve assembly shown in FIG. 8, the modular card sleeve assembly illustrated in a horizontal spread configuration, and further showing a card being inserted into the modular card sleeve assembly;

FIG. 10 is a front perspective view of the modular card sleeve assembly shown in FIG. 9, the modular card sleeve assembly illustrated in an opened configuration; and FIG. 11 is a front perspective view of the modular card sleeve assembly according to another embodiment of the present disclosure, and further showing the modular card sleeve assembly having a base modular card sleeve without a flap, the base modular card sleeve further affixed to a wallet.

DETAILED DESCRIPTION

The following detailed description and appended drawings describe and illustrate various embodiments of the invention. The description and drawings serve to enable one skilled in the art to make and use the invention and are not intended to limit the scope of the invention in any manner. In respect of the methods disclosed, the order of the steps presented is exemplary in nature, and thus, is not necessary or critical unless otherwise disclosed.

As shown in FIGS. 1-11, the present disclosure includes a modular card sleeve 100 (shown in FIGS. 1-4) and a modular card sleeve assembly 200 (shown in FIGS. 5-11) formed from a connected plurality of the modular card sleeves 100. The modular card sleeve assembly 200 has a closed configuration 152 (shown in FIG. 8), a horizontal spread configuration 154 (shown in FIG. 9), and an open configuration 156 (shown in FIGS. 10-11) as described further herein.

Figure 1:
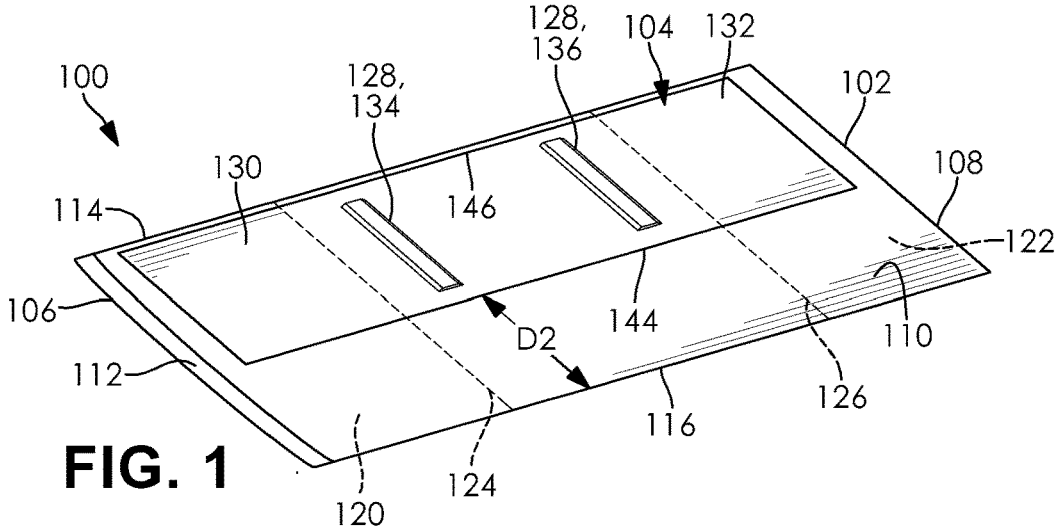
FIG. 1 is a front perspective view of a modular card sleeve according to one embodiment of the disclosure, and further showing a front side of the modular card sleeve with a flap attached to the front side, the flap having a pair of wings.

With reference to FIG. 1, a modular card sleeve 100 has a hollow main body 102 and a flap 104. The hollow main body 102 has an opened end 106, a closed end 108, a front side 110, a rear side 112, a leading edge 114, and a trailing edge 116. The closed end 108 is disposed on the hollow main body 102 opposite the opened end 106.

In particular examples, the hollow main body 102 is configured to hold an item 118 such as a card within, for example, as shown in FIG. 9. The opened end 106 is configured to receive the item 118 for placement of the item 118 within the hollow main body 102.

Within the present disclosure, non-limiting examples of the item 118 for insertion into the hollow main body 102 may include a credit card, a license, a debit card, and a reward card. It should be appreciated that although the term "card" is used generally herein, the item 118 may also include photographs or any other item that can fit within the hollow main body 102, as desired.

In some examples, the modular card sleeve 100 is manufactured using a flexible material such as plastic. More specifically, the hollow main body 102 is formed from a flexible material that is transparent or translucent. Desirably, the transparent or translucent hollow main body 102 permits a user to see the item 118 stored within the hollow main body 102, without having to remove the item 118 from the hollow main body 102. It should be appreciated that other flexible materials may also be selected for the modular card sleeve 100 within the scope of this disclosure.

In order to accommodate standard credit cards as the item 118, the hollow main body 102 may have a first body length BL1 of about eighty-five millimeters (85.60 mm) and a body width BW of about fifty-three millimeters (53.98 mm). The body width BW may be selected so as to accommodate the width of a standard credit card as the item 118. Although these dimensions are being supplied for the purpose of illustrating the modular card sleeve 100 of the present disclosure, it should be appreciated that a person skilled in the art may select other suitable dimensions for the hollow main body 102, as desired.

In some examples, the first body length BL1 is less than the length of the item 118. It should be appreciated that where the body length BL1 is less than the length of the item 118, a portion of the item 118 remains outside the hollow main body 102. Advantageously, the portion of the item 118 that remains outside of the hollow main body 102 functions as a convenient area for the user to grasp the item 118 for removal.

In particular embodiments, and as shown in FIG. 9, the front side 110 of the hollow main body 102 has a second body length BL2 that is less than the first body length BL1. Advantageously, a gap G is defined by the distance between the first body length BL1 and the second body length BL2, and further functions as a convenient location for the user to easily grab and remove the item 118 from the hollow main body 102.

Figure 3:
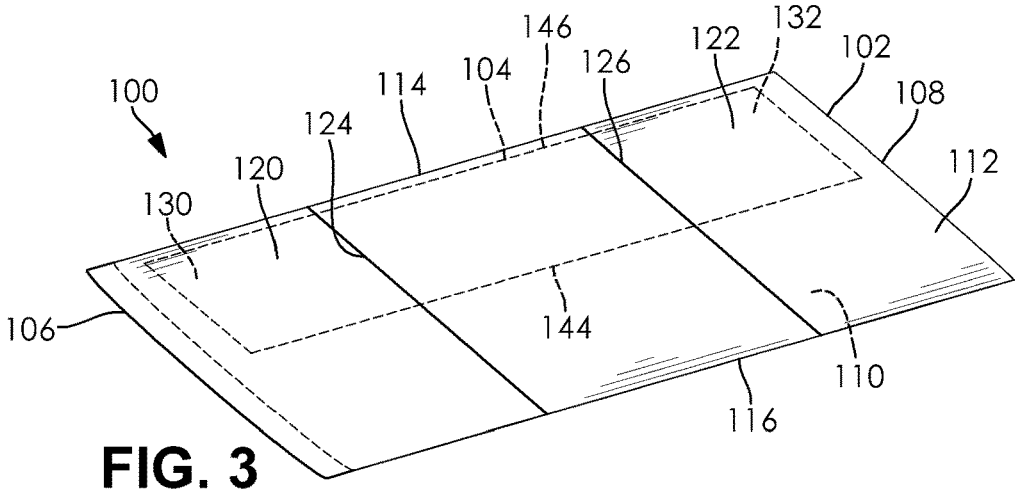
FIG. 3 is a rear perspective view of the modular card sleeve shown in FIG. 2, and further showing a rear side of the modular card sleeve with a first pouch and a second pouch.

With reference to FIGS. 3-4, the rear side 112 of the hollow main body 102 has a first pouch 120 and a second pouch 122 disposed thereon. In some examples, the first pouch 120 and the second pouch 122 are separate pieces that are affixed to the hollow main body 102. In more specific examples, the first pouch 120 and the second pouch 122 are affixed to the hollow main body 102 by sonic welding. It should be appreciated that other methods of affixing the pouch 120 and the second pouch 122 may be employed by a skilled artisan, as desired.

In other embodiments, the first pouch 120 and the second pouch 122 are co-formed with the hollow main body 102 as a single, unitary, and one-piece structure.

With continued reference to FIGS. 3-4, the first pouch 120 has a first opening 124. The second pouch 122 has a second opening 126. The first opening 124 faces the second opening 126 of the second pouch 122. As shown in FIG. 9, the first pouch 120, the second pouch 122, the first opening 124, and the second opening 126 each share the body width BW sufficient to receive a flap width FW of the flap 104.

Furthermore, the flap width FW is selected to be substantially less than the body width BW so that the hollow main bodies 102 upon assembly can be moved to and from the horizontal spread configuration 154 as described further herein. In more specific examples, the body width BW is about five-and-one-half centimeters (5.5 cm) and the flap width FW is around three-and-one-half centimeters (3.5 cm). It should be appreciated that these differences in the dimensions FW and BW allow the modular card sleeve assembly 200 to be used in the horizontal spread configuration 154. It should also be appreciated that although these dimensions have been shown to be useful, other dimensions may be selected by a person skilled in the art, within the scope of this disclosure.

Figure 2:
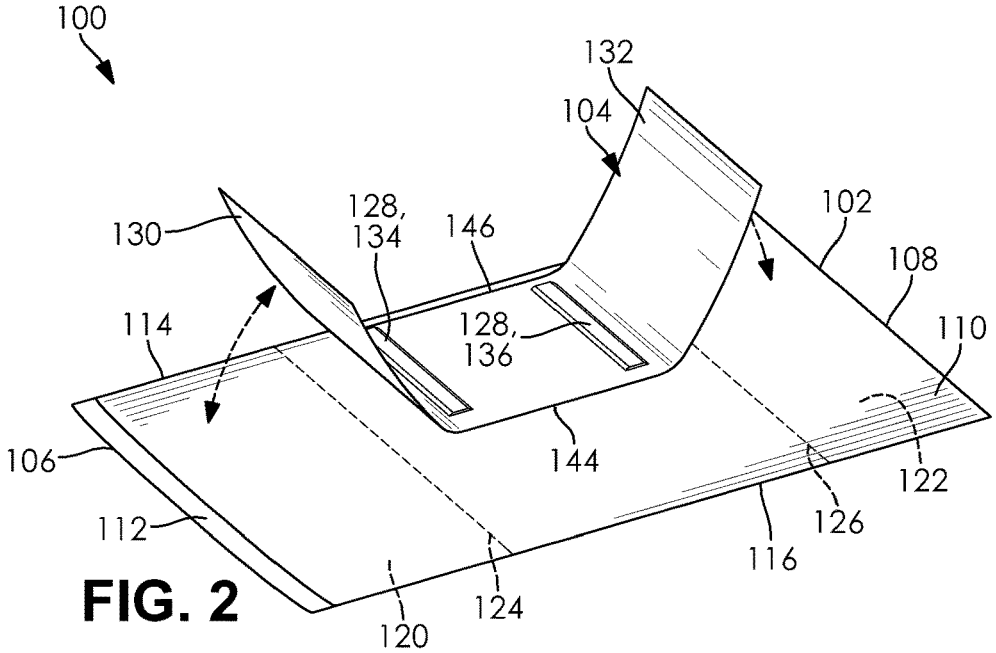
FIG. 2 is a front perspective view of the modular card sleeve shown in FIG. 1, and further showing the wings of the flap being bent upwardly from the front side of the modular card sleeve.

As shown in FIGS. 1-2, the flap 104 has at least one connecting portion 128, a first wing 130, and a second wing 132. In some examples, and as shown in FIG. 9, the flap 104 has a flap length FL. The flap length FL is less than the first body length BL1. As will be described further below, having the flap length FL be less than the first body length BL1 allows the first wing 130 and the second wing 132 to be more easily inserted in the first pouch 120 and the second pouch 122, respectively.

With continued reference to FIGS. 1-2, it should be appreciated that the at least one connecting portion 128 is configured to not only attach the flap 104 to the hollow main body 102, but also minimize lateral movement of the hollow main body 102 upon assembly into the modular card assembly 200 as described further herein. In particular, the at least one connecting portion 128 is disposed between the first wing 130 and the second wing 132. Also, the at least one connecting portion 128 is disposed on the front side 110 of the hollow main body 102. In some examples, the at least one connecting portion 128 is affixed to the front side 110 of the hollow main body 102 via an adhesive, such as a glue or other bonding agent. In other examples, the at least one connecting portion 128 is fused to the front side 110 of the hollow main body 102 with a heat- or sonic-welding method. It should be appreciated that a skilled artisan may select other suitable adhesives and methods to affix or fuse the at least one connecting portion 128 to the front side 110 of the hollow main body 102, within the scope of this disclosure.

As shown in FIGS. 5-7, the first wing 130 and the second wing 132 are configured to be manually disposed within the first pouch 120 and the second pouch 122 of another modular card sleeve 100, respectively. The disposing of the first wing 130 and the second wing 132 in the first pouch 120 and the second pouch 122 of another card sleeve 100 removably attaches the modular card sleeve 100 with another modular card sleeve 100. Advantageously, the user can manually add or remove any suitable number of the modular card sleeves 100 in order to accommodate the storage needs of the user.

It should also be appreciated that since the at least one connecting portion 128 is disposed on the hollow main body 102 and the first wing 130 and the second wing 132 are unattached from the hollow main body 102, the first wing 130 and the second wing 132 are allowed to have greater ranges of flexibility. Desirably, having greater ranges of flexibility, simplifies the manually insertion of the first wing 130 and the second wing 132 into the first pouch 120 and the second pouch 122, respectively.

In some examples, and as shown in FIG. 5, each of the first wing 130 and the second wing 132 has a wing height WH. In addition, each of the first pouch 120 and the second pouch 122 has a pouch depth DP. The wing height HW is less than the pouch depth DP. Advantageously, this allows the modular card sleeve 100 to be more easily inserted into, and removed from, another modular card sleeve 100 due to there being less opportunity for interference between the first wing 130 and the first pouch 120, and the second 132 and the second pouch 122.

In a further example, and as shown in FIG. 9, the at least one connecting portion 128 may include a first connecting portion 134 and a second connecting portion 136. The first connecting portion 134 is spaced apart from the second connecting portion 136. For example, the first connecting portion 134 is oriented along a first axis 138. The first axis 138 is disposed adjacent to the first opening 124 of the first pouch 120. The second connecting portion 136 is oriented along a second axis 140. The second axis 140 is disposed adjacent to the second opening 126 of the second pouch 122. The second axis 140 is oriented parallel to the first axis 138.

In addition, there is a connecting portion length CL that is defined by the distance between the first axis 138 and the second axis 140. Also, there is a first distance D1 that is defined by the distance between the first opening 124 of the first pouch 120 and the second opening 126 of the second pouch 122. In particular examples, the connecting portion length CL is only slightly less than the first distance D1. This slight difference in length between the connecting portion length CL and the first distance D1 permits there to be minimal gaps between the first axis 138 and the first opening 124 and the second axis 140 and the second opening 126. The minimal gaps allow the first wing 130 and the second wing 132 to be disposed within the first pouch 120 and the second pouch 122, respectively, while still militating against any significant lateral movement of the modular card sleeve 100 when assembled in the modular card sleeve assembly 200. It should be appreciated that other configurations of the first connecting portion 134 and the second connecting portion 136 may be employed by a person skilled in the art, within the scope of this disclosure.

It should also be appreciated that the connecting portion length CL is scalable according to a skilled artisan, as desired. For example, increasing the connecting portion length CL decreases the lateral movement of the modular card sleeve 100 when assembled in the modular card sleeve assembly 200. Decreasing the connecting portion length CL increases lateral movement but allows the first wing 130 and the second wing 132 to be manually inserted more easily in the first pouch 120 and the second pouch 130, respectively.

In some examples, and with reference to FIGS. 1-2, the flap 104 is arranged on the front side 110 of the hollow main body 102 in an offset position from the center of the modular card sleeve 100 in order to permit the assembly 200 to be moved to the horizontal spread configuration 154 (shown in FIG. 9). In more specific examples, the offset position is proximal to the leading edge 114 and distal to the trailing edge 116.

With continued reference to FIGS. 1-2, the flap 104 may further have an inner edge 144 and an outer edge 146. The inner edge 144 is spaced apart a second distance D2 from the trailing edge 116 of the hollow main body 102. The outer edge 146 is disposed adjacent to the leading edge 114 of the hollow main body 102. As mentioned below, the length of the second distance D2 directly influences how far the modular card sleeve 100 can be moved horizontally in the horizontal spread configuration 154 (shown in FIG. 9). Therefore, the length of the second distance D2 may be selected by a person skilled in the art as desired.

As shown in FIGS. 7-11, the modular card sleeve assembly 200 including the plurality of the modular card sleeves 100 may be disposed in each of the closed configuration 152, the horizontal spread configuration 154, and the open configuration 156. In some examples, the plurality of the modular card sleeves 100 include a first modular card sleeve 148 and a second modular card sleeve 150. It should be appreciated that the number of modular card sleeves 100 is scalable and a person skilled in the art may select different numbers of modular card sleeves 100, as desired. For example, and as shown in FIGS. 7-11, the modular card sleeve assembly 200 may further include a third modular card sleeve 166. In addition, FIGS. 8-11 show that the modular card sleeve assembly 200 may further include a fourth modular card sleeve 168. Other suitable numbers of the modular card sleeves 100 may also be employed.

In operation, and as shown in FIG. 5-7, the modular card sleeve assembly 200 is assembled by manually inserting the first wing 130 and the second wing 132 of the second modular card sleeve 150 into the first pouch 120 and the second pouch 122 of the first modular card sleeve 148. This operation is repeated for each modular card sleeve 100 added to the modular card sleeve assembly 200. For example, FIG. 7 shows the same process but with the addition of the third modular card sleeve 166.

Advantageously, disposing the first wing 130 and the second wing 132 of the second modular card sleeve 150 into the first pouch 120 and the second pouch 122 of the first modular card sleeve 148, respectively, friction fits the first modular card sleeve 148 to the second modular card sleeve 150. Desirably, the friction fit militates against the first wing 130 and second wing 132 of the second modular card sleeve 150 from being accidentally removed from the first pouch 120 and the second pouch 122 of the first modular card sleeve 148, respectively, unless sufficient manual force is employed by the user. It should be appreciated that while friction fitting the first wing 130 and the second wing 132 to the first pouch 120 and the second pouch 122, respectively, has shown to be useful, other suitable connecting methods may be employed by a skilled artisan within the scope of the present disclosure.

The closed configuration 152 of the modular card sleeve assembly 200 is shown in FIG. 8. The closed configuration 152 is provided where the leading edge 114 of the first modular card sleeve 148 is coplanar with the leading edge 114 of the second modular card sleeve 150. In addition, the trailing edge 116 of the first modular card sleeve 148 is coplanar with the trailing edge 116 of the second modular card sleeve 150 where the modular card sleeve assembly 200 is in the closed configuration 152. Conveniently, the closed configuration 152 condenses the modular card sleeve assembly 200 into an organized stack, thereby allowing for easy storage of the items 118 by the user.

The horizontal spread configuration 154 of the modular card sleeve assembly 200 is shown in FIG. 9. The horizontal spread configuration 154 is provided where the first modular card sleeve 148 is spaced apart from the second modular card sleeve 150 via a manual moving of the flap 104 of the first modular card sleeve 148 towards the trailing edge 116 of the second modular card sleeve 150. It should be appreciated that the flap 104 is able to travel towards the trailing edge 116 due to the body width BW being greater than the flap width FW, as described hereinabove. Desirably, the horizontal spread configuration 154 allows the user to easily review the item 118 stored in each of the hollow main body 102 of the plurality of modular card sleeve 100 without having removed the item 118.

Now referencing FIGS. 10-11, the open configuration 156 of the modular card sleeve assembly 200 is shown. The open configuration 156 is provided where the leading edge 114 of the first modular card sleeve 148 is coplanar with the leading edge 114 of the second modular card sleeve 150, but the trailing edge 116 of the first modular card sleeve 148 is not coplanar with the trailing edge 116 of the second modular card sleeve 148. It should be appreciated that this configuration may be achieved due to the flexibility of each of the first wing 130 and the second wing 132, which permits for the first modular card sleeve 148 and the second modular card sleeve 150 to be effectively opened as a "book." Advantageously, the open configuration 156 provides the user another way to view the item 118 stored in each of the hollow main body 102 of the first modular card sleeve 148 and the second modular card sleeve 150 without removing the item 118.

In further embodiments, and shown particularly in FIG. 11, the modular card sleeve assembly 200 may be disposed in, or attached to, a wallet 158. The wallet 158 has an inside surface 160 and an outside surface 162. In some examples, the plurality of modular card sleeves 100 are disposed within the wallet 158. In other examples, the leading edge 114 of one of the plurality of modular card sleeves 100 is attached to the inside surface 160 of the wallet 158. Other suitable means for disposing or connecting the modular card sleeve assembly 200 with the wallet 158 may also be selected within the scope of the present disclosure.

In yet further embodiments, and while still referencing FIG. 11, the modular card sleeve assembly 200 further includes a base modular card sleeve 164. The base modular card sleeve 164 does not have the flap 104, but otherwise is the same or similar structure as the modular card sleeve 100 with the flap 104. In some examples, the base modular card sleeve 164 is attached to the inside surface 160 of the wallet 158, with the plurality of the modular card sleeves 100 connected to the base modular card sleeve 164. It should be appreciated that the use of the base modular card sleeve 164 may be more visually appealing, and also minimizes an opportunity for a free one of the flaps 104 to otherwise catch or interfere with the wallet 158.

Advantageously, the modular card sleeve 100 and the modular card sleeve assembly 200 facilitates organization of the items 118 via each of the closed configuration 152, the horizontal spread configuration 154, and the open configuration 156. In addition, the modular card sleeve 100 can be manually connected or removed from another modular card sleeve 100 for increased or decreased storage capacity of the items 118.

While certain representative embodiments and details have been shown for purposes of illustrating the invention, it will be apparent to those skilled in the art that various changes may be made without departing from the scope of the disclosure, which is further described in the following appended claims.

What is claimed is:

1. A modular card sleeve, comprising:

a hollow main body having an opened end, a closed end, a front side, a rear side, a leading edge, and a trailing edge, the opened end configured to receive a card for placement of the card within the hollow main body, the closed end disposed opposite the opened end, the rear side having a first pouch adjacent the opened end between the leading edge and the trailing edge, and a second pouch adjacent the closed end between the leading edge and the trailing edge, wherein the first pouch and the second pouch are disposed on the rear side, the first pouch having a first opening and the second pouch having a second opening, and the first opening of the first pouch facing the second opening of the second pouch; and a flap having a first wing disposed opposite the first pouch, a second wing disposed opposite the second pouch, and at least one connecting portion disposed between the first wing and the second wing, the at least one connecting portion disposed on the front side.

2. The modular card sleeve of claim 1, wherein the first pouch is configured to receive a first wing of another modular card sleeve and the second pouch is configured to receive a second wing of the another modular card sleeve.

3. The modular card sleeve of claim 1, wherein the flap is arranged on the front side of the hollow main body in an offset position from a center of the modular card sleeve.

4. The modular card sleeve of claim 3, wherein the offset position is proximal to the leading edge and distal to the trailing edge.

5. The modular card sleeve of claim 4, wherein the flap has an inner edge and an outer edge, the outer edge of the flap disposed adjacent to the leading edge of the hollow main body, and the inner edge of the flap spaced apart from the trailing edge of the hollow main body a first distance.

6. The modular card sleeve of claim 4, wherein the at least one connecting portion is one of fused to the front side of the modular card sleeve and affixed to the front side of the modular card sleeve with an adhesive.

7. The modular card sleeve of claim 6, wherein the at least one connecting portion includes a first connecting portion and a second connecting portion, the second connecting portion spaced apart from the first connecting portion.

8. The modular card sleeve of claim 7, wherein the first connecting portion is oriented along a first axis, and the second connecting portion is oriented along a second axis, and the first axis is oriented parallel to the second axis.

9. The modular card sleeve of claim 8, wherein the first axis is disposed adjacent to the first opening of the first pouch and the second opening is disposed adjacent to the second opening of the second pouch.

10. The modular card sleeve of claim 9, wherein the first wing has a first height and the first pouch has a first depth, and the first height is less than the first depth, and the second wing has a second height and the second pouch has a second depth, and the second height is less than the second depth.

11. The modular card sleeve of claim 1, wherein the hollow main body has a body length and the flap has a flap length, and the flap length is less than the body length.

12. The modular card sleeve of claim 1, wherein the hollow main body is transparent or translucent.

13. The modular card sleeve of claim 12, wherein the modular card sleeve is a flexible plastic material.

14. A modular card sleeve assembly, comprising:

a plurality of modular card sleeves including a first modular card sleeve and a second modular card sleeve; and each of the plurality of modular card sleeves having a hollow main body having an opened end, a closed end, a front side, a rear side, a leading edge, and a trailing edge, the opened end configured to receive a card for placement of the card within the hollow main body, the closed end disposed opposite the opened end, the rear side having a first pouch adjacent the opened end between the leading edge and the trailing edge, and a second pouch adjacent the closed end between the leading edge and the trailing edge, wherein the first pouch and the second pouch are disposed on the rear side, the first pouch having a first opening and the second pouch having a second opening, and the first opening of the first pouch facing the second opening of the second pouch, and a flap having a first wing, a second wing, and at least one connecting portion disposed between the first wing and the second wing, the at least one connecting portion disposed on the front side, and wherein the first wing of the second modular card sleeve is disposed within the first pouch of the first modular card sleeve and the second wing of the second modular card sleeve is disposed within the second pouch of the first modular card sleeve, and wherein the modular card sleeve assembly further includes a closed configuration, a horizontal spread configuration, and an open configuration.

15. The modular card sleeve assembly of claim 14, wherein the closed configuration is where the leading edge of the first modular card sleeve is coplanar with the leading edge of the second modular card sleeve, and where the trailing edge of the first modular card sleeve is coplanar with the trailing edge of the second modular card sleeve.

16. The modular card sleeve assembly of claim 14, wherein the horizontal spread configuration is where the second modular card sleeve is spaced apart from the first modular card sleeve by moving the flap of the second modular card sleeve towards the trailing edge of the first modular card sleeve.

17. The modular card sleeve assembly of claim 14, wherein the open configuration is where the leading edge of the first modular card sleeve is coplanar with the leading edge of the second modular card sleeve, and the trailing edge of the first modular card sleeve is not coplanar with the trailing edge of the second modular card sleeve.

18. The modular card sleeve assembly of claim 14, wherein the plurality of modular card sleeves further includes a base modular card sleeve, the base modular card sleeve does not have a flap.

19. A modular card sleeve assembly, comprising:

a wallet;

a plurality of modular card sleeves disposed in the wallet, including a first modular card sleeve and a second modular card sleeve;

each of the plurality of modular card sleeves having a hollow main body having an opened end, a closed end, a front side, a rear side, leading edge, and a trailing edge, the opened end configured to receive a card for placement of the card within the hollow main body, the closed end is disposed opposite the opened end, the rear side having a first pouch adjacent the opened end between the leading edge and the trailing edge, and a second pouch adjacent the closed end between the leading edge and the trailing edge, wherein the first pouch and the second pouch are disposed on the rear side, and wherein the first pouch is opposite to the second pouch, a flap having a first wing, at least one connecting portion, and a second wing, the at least one connecting portion disposed on the front side in an offset position proximal to the leading edge and distal to the trailing edge; and wherein the first wing of the second modular card sleeve is disposed within the first pouch of the first modular card sleeve and the second wing of the second modular card sleeve is disposed within the second pouch of the first modular card sleeve.

20. The modular card sleeve assembly of claim 19, wherein the wallet includes an inside surface and an outside surface, and a means for attaching the leading edge of one of the plurality of modular card sleeves to the inside surface of the wallet.

* * * * *